US007845595B2

(12) United States Patent
Goddard

(10) Patent No.: US 7,845,595 B2
(45) Date of Patent: Dec. 7, 2010

(54) CELLULOSE-BASED AERIAL DELIVERY SYSTEM AND METHOD OF USE

(75) Inventor: Richard V. Goddard, Hanford, CA (US)

(73) Assignee: Caylym Technologies International, LLC, San Diego, CA (US)

( * ) Notice: Subject to any disclaimer, the term of this patent is extended or adjusted under 35 U.S.C. 154(b) by 0 days.

(21) Appl. No.: 12/641,188

(22) Filed: Dec. 17, 2009

(65) Prior Publication Data

US 2010/0147539 A1 Jun. 17, 2010

Related U.S. Application Data

(63) Continuation of application No. 11/246,507, filed on Oct. 7, 2005, now abandoned.

(51) Int. Cl.
*A62C 3/02* (2006.01)
*B65D 43/02* (2006.01)

(52) U.S. Cl. ..... 244/137.3; 169/47; 169/53; 169/70; 229/125.22; 229/125.38; 244/136

(58) Field of Classification Search ..... 169/30, 169/34, 46, 47, 53, 70; 244/136, 137.3; 222/1, 222/105, 107; 229/125.02, 125.22, 125.38
See application file for complete search history.

(56) References Cited

U.S. PATENT DOCUMENTS

| | | | | |
|---|---|---|---|---|
| 2,306,321 | A | | 12/1942 | Roberts |
| 2,784,895 | A | | 3/1957 | Linwood, Jr. et al. |
| 3,066,842 | A | | 12/1962 | Croley |
| 3,401,905 | A | * | 9/1968 | Rohrlick ..... 244/137.3 |
| 3,485,302 | A | | 12/1969 | Thorpe |
| 3,710,868 | A | | 1/1973 | Chadwick |
| 3,741,462 | A | | 6/1973 | Flint et al. |
| 3,853,235 | A | * | 12/1974 | Lambert et al. ..... 414/412 |
| 3,904,105 | A | | 9/1975 | Booth |
| 4,194,652 | A | | 3/1980 | Williamson et al. |
| 4,807,299 | A | | 2/1989 | Nattrass et al. |
| 4,919,306 | A | | 4/1990 | Heaps, Jr. et al. |
| 5,012,972 | A | | 5/1991 | Nordstrom et al. |
| 6,470,805 | B1 | | 10/2002 | Woodall et al. |
| 7,090,029 | B2 | | 8/2006 | Cleary et al. |

* cited by examiner

*Primary Examiner*—Gary E Elkins
(74) *Attorney, Agent, or Firm*—Stetina Brunda Garred & Brucker

(57) ABSTRACT

The present invention is directed to an aerial delivery system that provides for the controlled delivery of items from an aircraft into a selected drop zone. In accordance with the present invention, the aerial delivery system includes a base and a sidewall arrangement adjacent the base. The sidewall arrangement generally acts as a sleeve defining an inner volume. Within the inner volume is a tray or cassette configured to be moveable within the inner volume. Adjacent the sidewall arrangement opposite the base is a top cover. The top cover is generally oversized relative to the shape defined by the sidewall arrangement. A plurality of straps connects the top cover, sidewall arrangement and, optionally, the material within the inner volume. The aerial delivery system is activated by an air stream that catches the oversized top cover, forcing the separation between the top cover and the other portions of the aerial delivery system. The separation of top cover places a load upon the straps that initiate the release of materials contained within the aerial delivery system.

7 Claims, 10 Drawing Sheets

FIG. 3
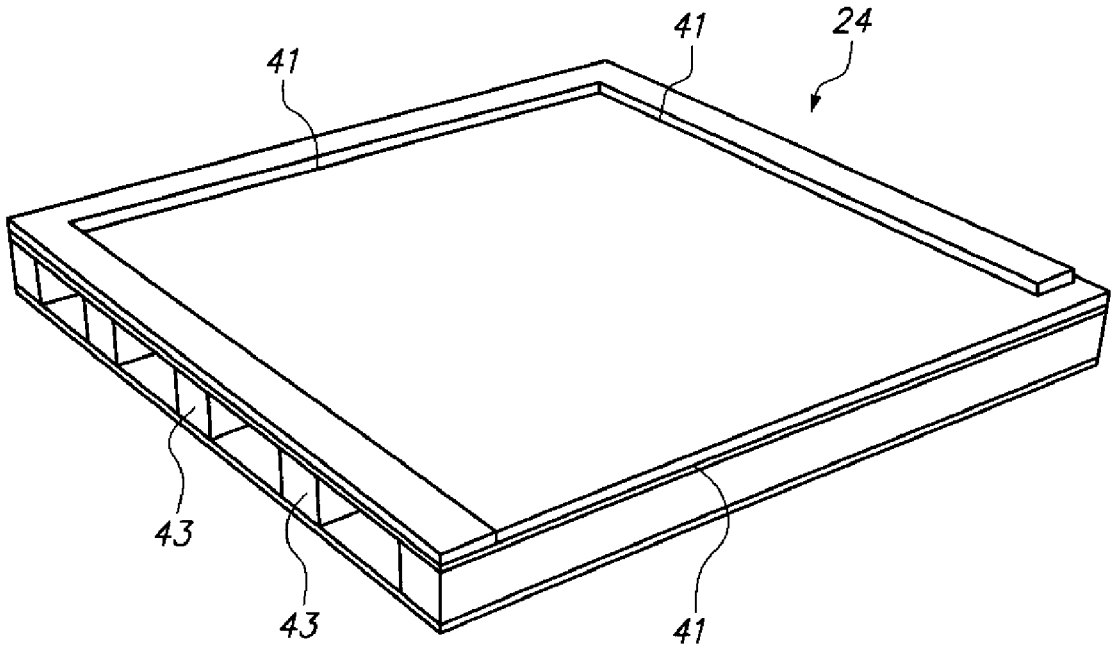
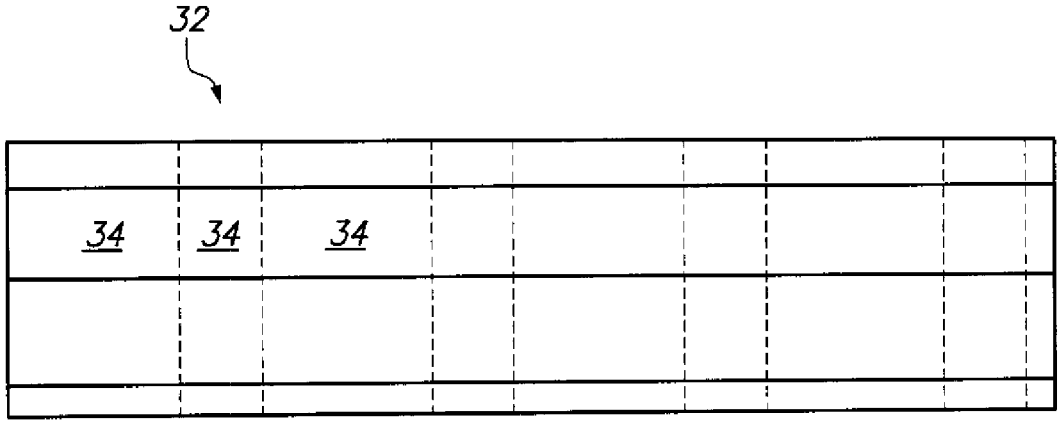
FIG. 4

CELLULOSE-BASED AERIAL DELIVERY SYSTEM AND METHOD OF USE

The present application is a continuation of U.S. patent application Ser. No. 11/246,507 entitled CELLULOSE-BASED AERIAL DELIVERY SYSTEM AND METHOD OF USE filed Oct. 7, 2005 now abandoned.

FIELD OF THE INVENTION

This invention relates generally to cellulose-based containers and, more specifically, to cellulose-based containers configured to hold and selectively dispense contents when the cellulose-based container is deployed from an aircraft.

BACKGROUND OF THE INVENTION

Aerial deployment of water and fire retardant chemicals in fighting fires is known in the art. Typically, an aircraft either loads on the fly from a large body of water such as a lake or river, or is loaded on the ground via hoses from tanks. In both cases, the water and/or chemical retardant is not contained within any kind of vessel once it leaves the aircraft. In short, the water and/or chemical retardant is a generally uncontrollable free body once it leaves the aircraft.

As such, under current practices many factors limit the pilot's ability to hit their desired target. For example, in fire suppression, the pilot must release the cargo relatively close to the ground to prevent the water or chemical retardant from dissipating in the air before it reaches the fire, and thus losing its effectiveness. Further, as the pilots must fly relatively close to the ground, night flying for fire suppression is not permitted. Finally, the loose nature of the cargo when currently dropped affects the pilot's ability to control where the cargo hits within the drop zone. As such, precision drops to relatively small drop zones in not practical, such as dropping absorbent or petroleum devouring material on oil slicks is not feasible.

SUMMARY OF THE INVENTION

The present invention is directed to an aerial delivery system that provides for the controlled delivery of items from an aircraft into a selected drop zone. In accordance with the present invention, the aerial delivery system includes a base and a sidewall arrangement adjacent the base. The base includes a buildup corresponding to a sidewall arrangement profile. The sidewall arrangement generally acts as a sleeve defining an inner volume. Within the inner volume is a base panel such as a tray or cassette that is configured to be moveable within the inner volume. Adjacent the sidewall arrangement opposite the base is a top cover. The top cover is generally oversized relative to the shape defined by the sidewall arrangement. A plurality of straps connects the top cover, sidewall arrangement and, optionally, the material within the inner volume. The aerial delivery system is activated by an air stream that catches the oversized top cover, forcing the separation between the top cover and the other portions of the aerial delivery system. The separation of top cover places a load upon the straps that initiate the release of materials contained within the inner volume.

The present invention further includes a method of accurately delivering a volume of material via an aerial drop to a target zone. The method includes releasing a cellulose-based container from an aircraft. The cellulose-based container includes a base, a sidewall arrangement and a top cover. The sidewall arrangement generally defines an inner volume that contains the volume of material. The inner volume may also contain a tray or cassette that forms a moveable bottom panel to the sidewall arrangement. A plurality of straps connects the top cover and the sidewall arrangement. The method further includes initiating the release of the volume of material by displacing the top cover from the rest of the cellulose-based container thereby placing sufficient tension on the straps to release the volume of material from the aerial delivery system.

BRIEF DESCRIPTION OF THE DRAWINGS

Various embodiments of the present invention are described in detail below with reference to the following drawings.

FIG. 3 is a perspective view of an aspect of the base made according to the present invention;

FIG. 4 is a plan view of a blank of the sidewall assembly made in accordance with an aspect of the present invention;

DETAILED DESCRIPTION OF THE INVENTION

The present invention will now be described with reference to the accompanying FIGURES. The present invention provides a plurality of container blanks and other structures that when combined as taught herein form an aerial delivery system. By way of overview and with reference to FIGS. 1 through 12*e*, an embodiment of the present invention includes sheets of formable material that may be cut, scored, shaped or otherwise arranged to form a aerial delivery system 20 that generally includes a base 24, sidewall arrangement 22 and top cover 26. Specific details of the aerial delivery system 20, its components and use are described with more particularity below.

Figure 2:
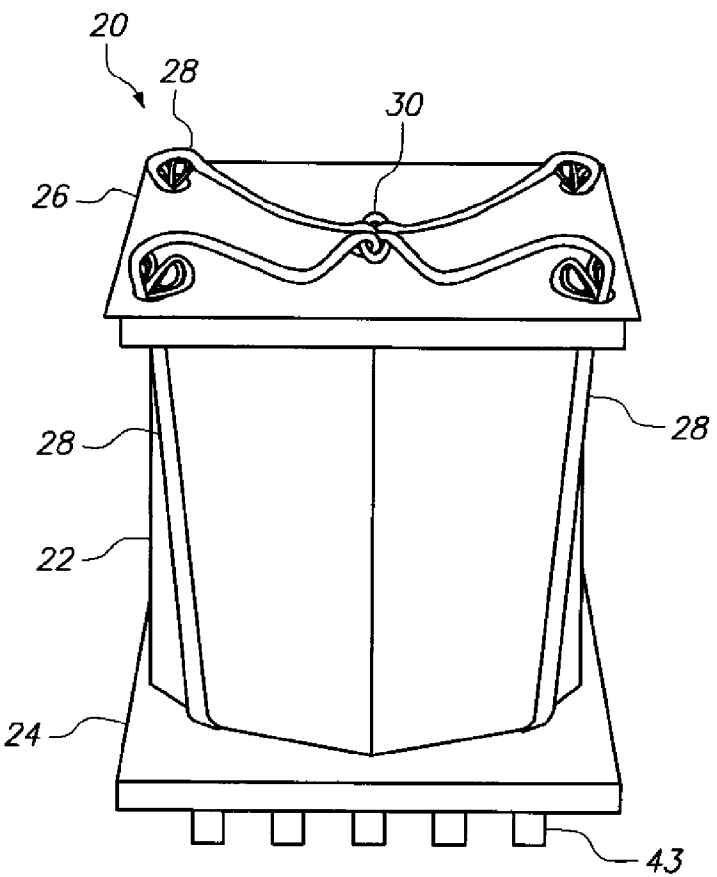
FIG. 2 is a another perspective view of yet another aspect of the aerial delivery system made in accordance with an aspect of the present invention.
Figure 1:
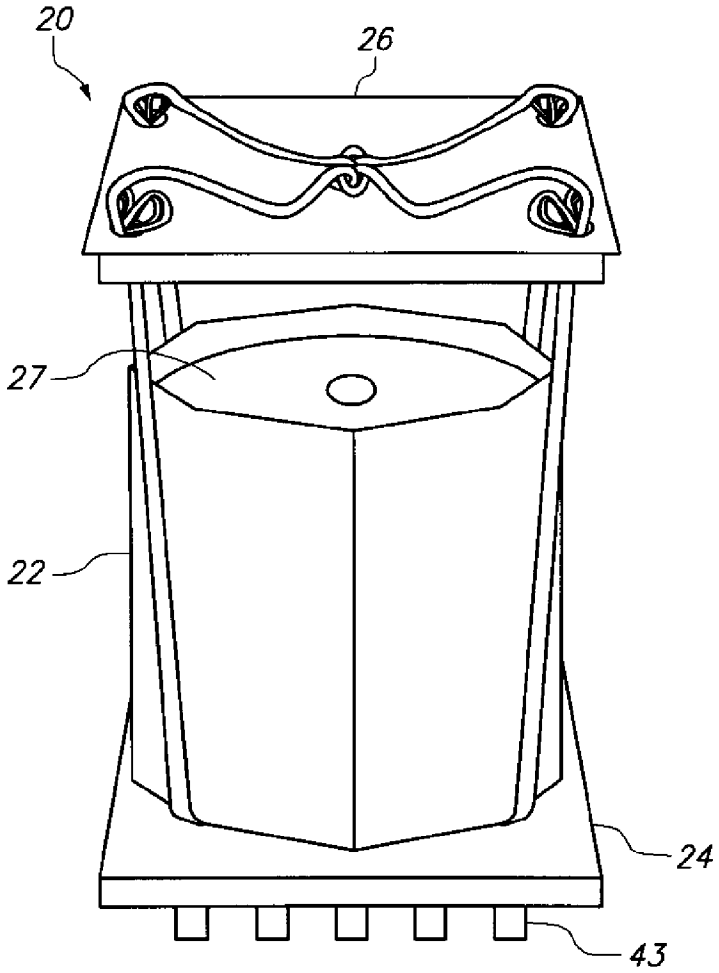
FIG. 1 is a partially exploded perspective view of an aspect of the aerial delivery system made in accordance with an aspect of the present invention.

With specific reference to FIGS. 1 and 2, various aspects of the aerial delivery system 20 are depicted. The aerial delivery system 20 generally includes a base 24, a sidewall arrangement 22, a top cover 26, and at least one strap 28 connecting the top cover 26 with either the contents 27 within the sidewall assembly 22, or directly to an inner surface of the sidewall assembly 22. As depicted in the FIGURES., the strap 28 runs through the surface of the top cover 26 around the outside surface of the sidewall assembly 22, between the sidewall assembly 22 and the base 24 and then into an inner volume formed by the sidewall assembly 22. However, it will be appreciated that the strap 28 may also go directly from the top cover 26 to the inside of the sidewall assembly 22 without departing from the spirit and scope of the present invention. The base 24 lies adjacent but is not connected to the strap 28. In this manner, when deployment is initiated, (discussed in more detail below) if the strap 28 is attached to the contents 27, such as, without limitation, being heat welded to a liquid impermeable polymer based bag 74, tension on the straps 28 tear the bag to release the contents 27. Similarly, if the straps 28 are attached to an inner surface of the sidewall arrangement 22, tension on the straps 28 tears the sidewall assembly to release the contents 27.

With respect to FIG. 3, the base 24 is typically a corrugated pallet having runners 43 on a bottom side and a buildup 41 on a top side. One suitable example of a corrugated pallet useful with the present invention is the multi-runner corrugated pallet produced by Weyerhaeuser Company's Spacekraft® business. The base 24 also includes a buildup 41 on the top side-opposite the side having the runners 43. The buildup 41 is essentially a berm of corrugated material that substantially defines the at least a portion of the sidewall arrangement profile. In this manner, the buildup 41 provides base support to the sidewall arrangement 22.

The runners 43 on the base 24 allow machines, such as fork lifts (not shown) to move the entire aerial delivery system 20 once loaded with content 27. Thus, an aircraft may be loaded relatively quickly when necessary. Likewise, any number of aerial delivery systems 20 may be assembled and stored in a ready state for use.

FIGS. 4-10 depict various blanks and erected elements configured to form a various parts of the aerial delivery system 20. The various blanks used to form the components of the aerial delivery system 20 are preferably constructed from a single piece of formable material such as, without limitation, sheets of cellulose-based materials formed from cellulose materials such as wood pulp, straw, cotton, bagasse, or the like. Cellulose-based materials used in the present invention come in many forms such as containerboard and corrugated containerboard. Likewise, additional forms may include single wall, double wall and triple wall corrugated containerboard materials. Still further, where additional strength is necessary, the cellulose-based materials may have more walls than a triple wall material, such as, four or greater walls. For purposes of this application, a wall is defined as a corrugated containerboard material having a corrugated medium between two liner sheets. Thus, a single wall corrugated containerboard material has two liner sheets and one corrugated medium. A double wall corrugated material has three liner sheets and two corrugated mediums. As a general rule, the number of "walls" is increased from a single wall corrugated containerboard material via adding one more liner sheet and one more corrugated member for each added "wall". The various blanks are cut and scored, perforated or other formed to include a plurality of panels that when erected and assembled form the aerial delivery system 20. In all FIGURES, like numbers indicate like parts. Additionally, cut lines are shown as solid lines, score lines as dashed lines, and lines of perforation as broken lines.

With specific reference to FIG. 4, the one possible configuration for the sidewall arrangement blank 32 is depicted. The sidewall arrangement blank 32 is a single sheet of cellulose material arranged to form a variety of side panels 34 that when erected form a generally octagon shaped sidewall assembly profile. As depicted in this FIGURE, there are no bottom flaps or panels included. However, it will be appreciated that the sidewall arrangement 22 may also include any variety of bottom flaps or panels as is determined desirable. As bottom flaps/panels are known in the art a detailed discussion or FIGURES showing their arrangement is not necessary herein to understand this aspect of the invention. Additionally the sidewall arrangements 22 depicted in FIG. 4 are configured to form an octagonal shaped sidewall arrangement profile. However, it will be appreciated that an aerial delivery system 20 having other geometries, such as, without limitation, square or rectangular, may also be employed with this invention without departing from the spirit and scope of the present invention. Further, it will be appreciated that if the geometry of the sidewall assembly 22 is altered, the other various element of the aerial delivery system 20 may also be altered accordingly without departing from the spirit and scope of the present invention. The sidewall assembly 22 may also include any number of metal or polymer bands 75 wrapped around the sidewall assembly's 22 outer surface to add hoop strength to the aerial delivery system 20.

Figure 5:
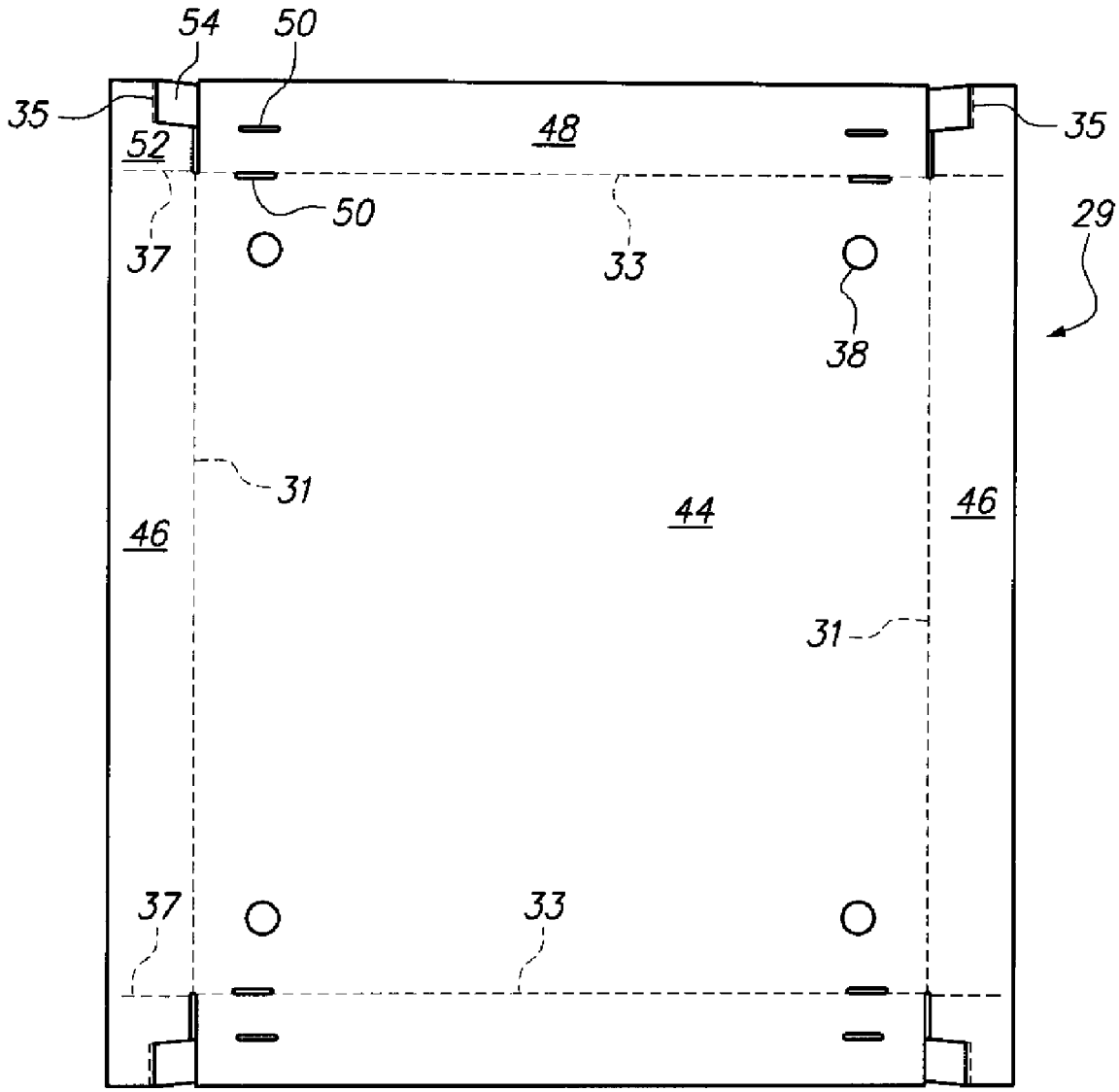
FIG. 5 is a plan view of a blank depicting a portion of the top cover made in accordance with an aspect of the present invention.
Figure 6:
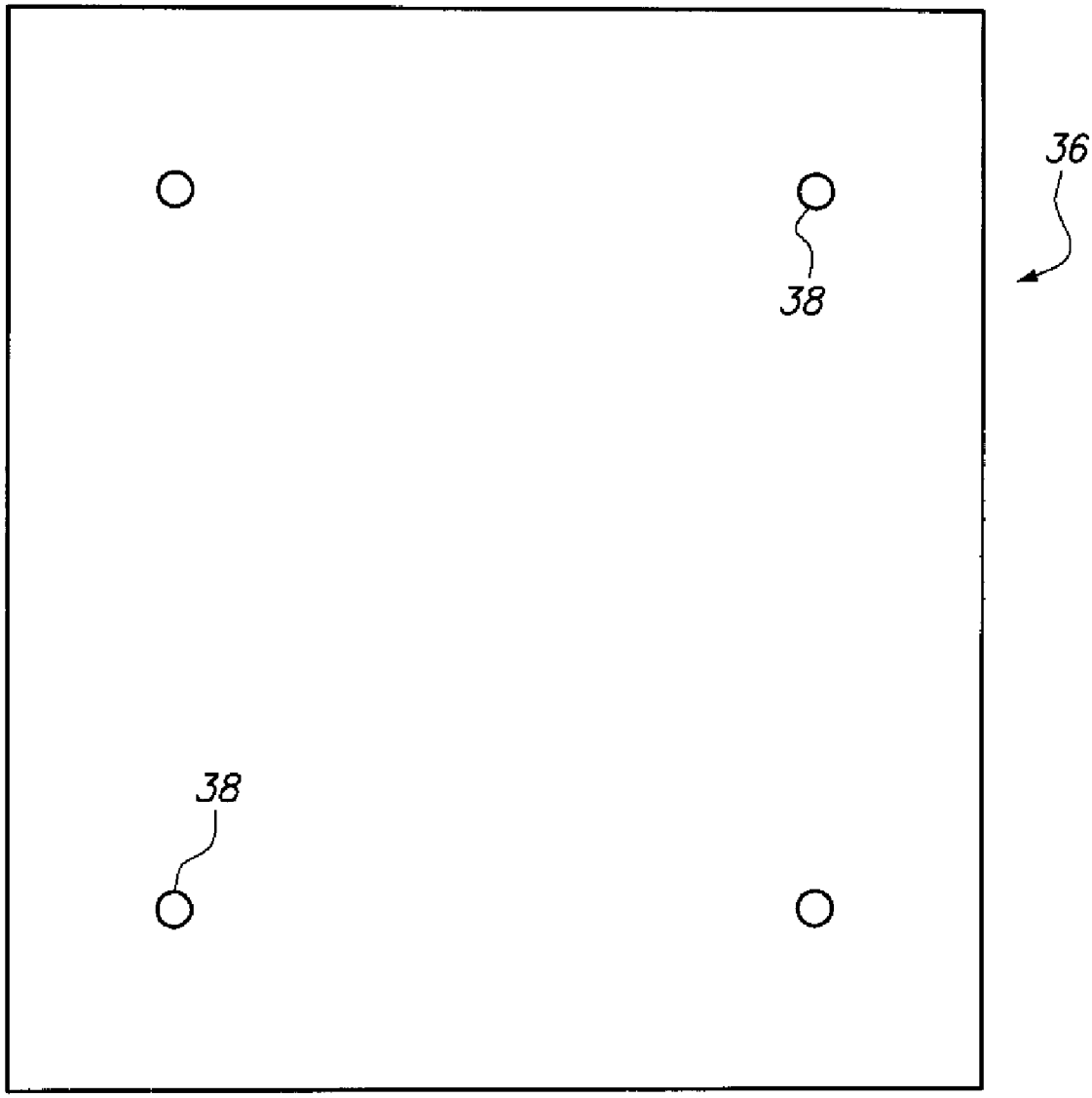
FIG. 6 is a plan view of blank depicting another portion of the top cover made in accordance with an aspect of the present invention.

With respect to FIGS. 5 and 6, elements of the top cover 26 are shown in more detail. The top cover 26 includes a top cover shell 29 and a top plate 36, laminated or otherwise joined together to form a single piece top cover 26. Specifically the top cover shell 29 includes a top panel 44. Top panel 44 includes opposed first top panel side flaps 46 hingedly connected to the top panel 44 along fold lines 31. Additionally, the top panel 44 includes opposed second top panel side flaps 48 attached along a fold line 33. The first top panel side flaps 46 have disposed on opposing ends corner panels 52 hingedly connected to the first top panel side flaps 46 along a fold line 37. Positioned off an edge of the corner panel 52 is the corner panel flap 54, which is hingedly connected to the corner panel 52 along a fold line 35. Further disposed through a surface of the top panel 44 are bores 38. Positioned in the second top panel side flaps 48 near the opposed ends are slots 50. Likewise, formed in the fold line 33 are additional slots 50. The various slots 50 are generally positioned and configured to receive the corner panel flap 54 when the top cover 26 is erected.

FIG. 6 depicts an aspect of the top plate 36. The top plate 36 is generally sized and shaped in the same size and shape as the top panel 44. Further, the top plate 36 includes bores 38 positioned as the bores in the top panel 44.

The top plate 36 is laminated or otherwise attached to the top panel 44 of the top cover shell 29 such that the respective bores 38 align. In an embodiment, the top cover shell 29 is a double wall cellulose-based material and the top plate 36 is a triple wall material. When laminated or otherwise joined, the top cover 26 has a five wall thickness in the top panel 44/top plate 36 region. It will be appreciated that such an arrangement is merely exemplary. As discussed above, the elements that make up the components of the aerial delivery system 20 may include any number of walls, from single wall on up without departing from the spirit and scope of the present invention.

Figure 7:
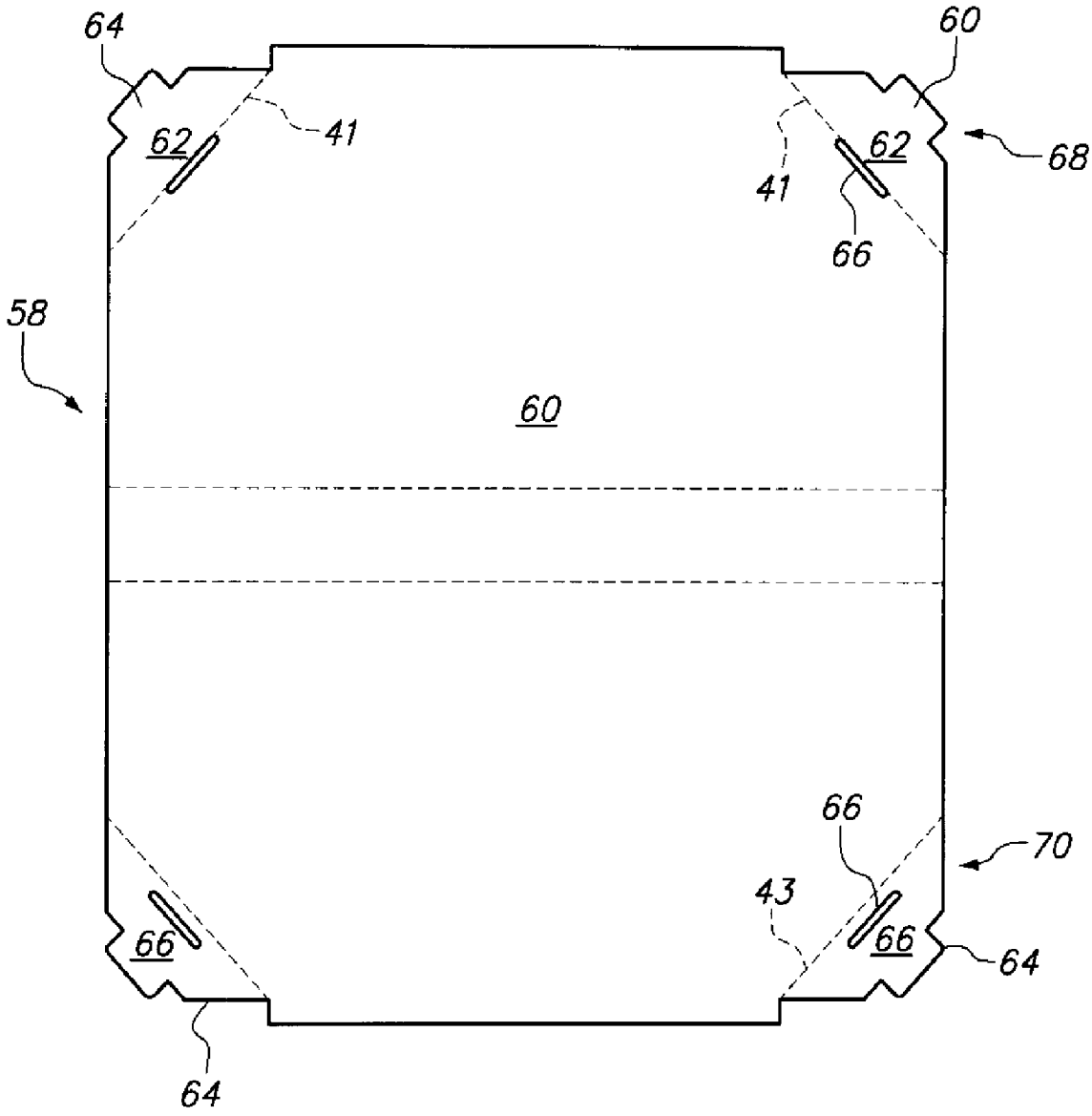
FIG. 7 is a plan view of a blank depicting a bag cassette made in accordance with an aspect of the present invention.

FIG. 7 depicts an aspect of the base plate 58 that is moveable within the sidewall arrangement 22. This configuration of the base plate 38 includes a base panel 60 which is substantially rectangular in shape. The base panel 60 includes at its corners two different folding tab slot assemblies. The first corner assembly 68 is depicted in the upper half of FIG. 7. Specifically a base plate corner panel 62 is hingedly connected with the base plate 60 along a fold line 41. Interposed with the fold line 41 is a slot 66 that lies along the fold line 41. The base plate corner panel 62 includes a base plate corner panel tab 64 extending from an outer surface of the base plate corner panel 62. Conversely, the second corner assembly 70 is somewhat similar to the first corner assembly 68; however, with two primary distinctions. First, the slot 66 does not lie along the fold line as indicated by 43. Rather, the slot 66 is positioned between the fold line 43 and an outer periphery of the respective base plate corner tab 64. Secondly, the base plate corner panel tab 64 of the second corner assembly is somewhat smaller than the base plate corner panel tab 64 of the first corner assembly 68.

Figure 8:
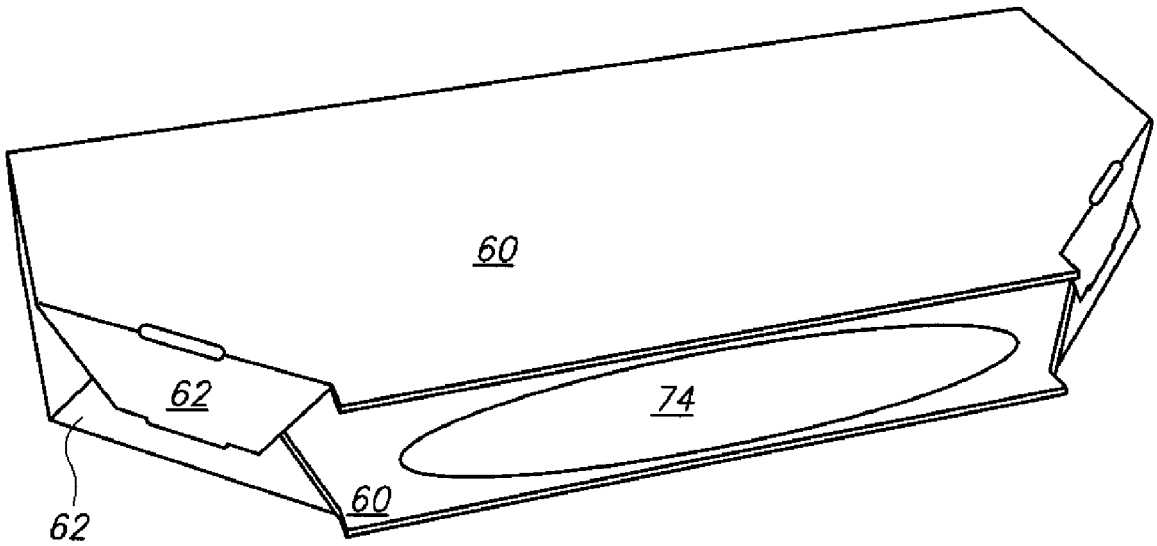
FIG. 8 is a partial perspective view of an assembled bag cassette made from the blank of FIG. 7.

With specific reference to FIG. 8, it will be appreciated how this aspect of the base plate 50 is configured. Specifically, opposing base plates 50 are such that one first corner panel assembly 68 of one base plate 58 lays juxtaposed one second corner assembly 70 of another base plate 58. In this manner, the first corner assembly 68 may be folded upwardly along a fold line 41. Likewise the respective second corner assembly 70 may be folded upwardly along fold line 43. The respective base plate corner panel tabs 64 may then be inserted into the respective slots of the other base plate 58. In this manner a locking arrangement is achieved between the two panels.

As best seen in FIG. 8, this configuration of the base plate 58 provides an open area between the joined base panels 60, forming a bag cassette. Within this space, contents 27, such as, without limitation, a bag 74 filled with water or fire retardant chemicals may be place. It will be appreciated that the opposed respective base panels 60 will provide a level of protection to the contents 27 placed therein.

Figure 9:
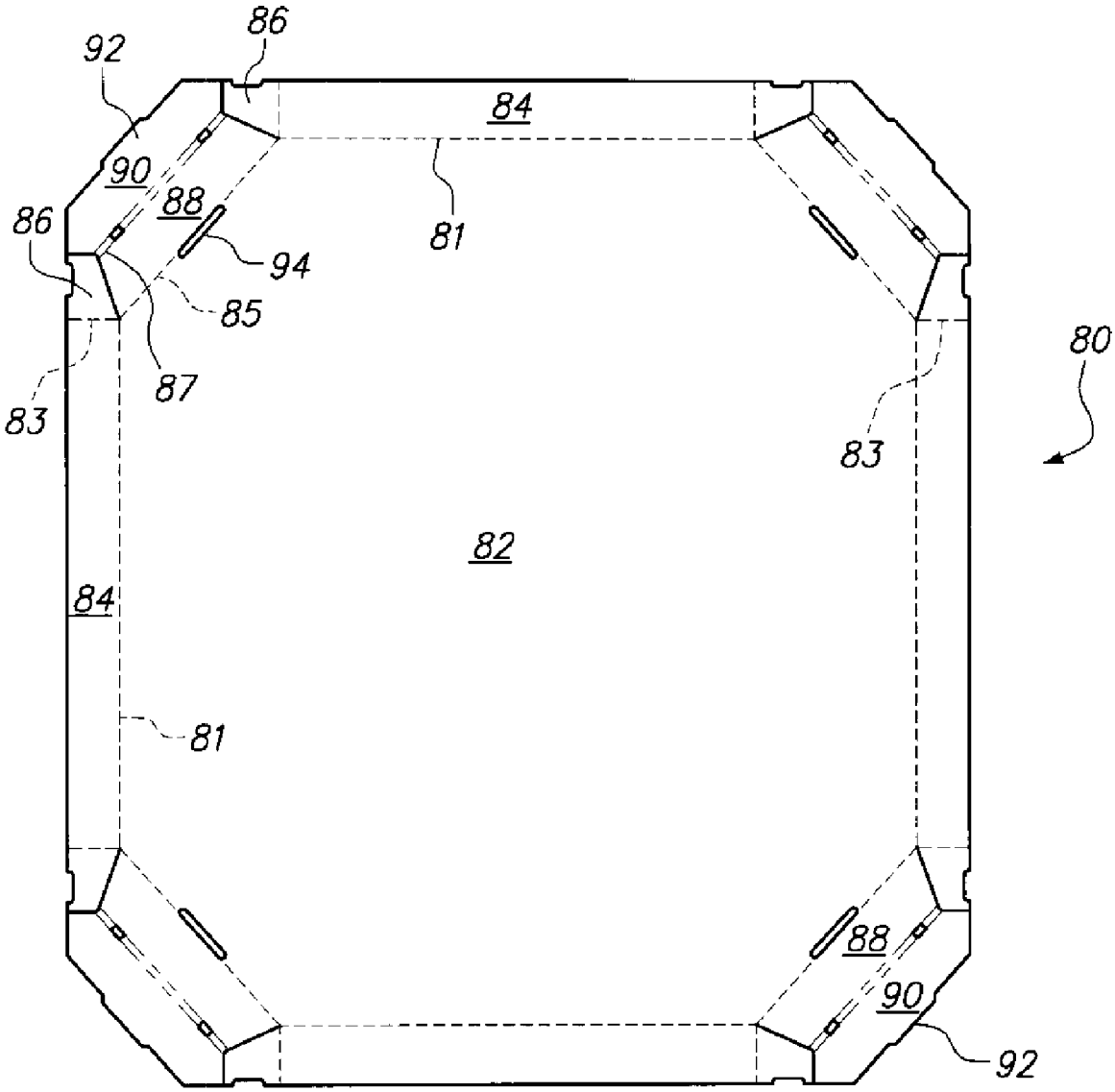
FIG. 9 is a plan view depicting a tray blank made in accordance with an aspect of the present invention.
Figure 10:
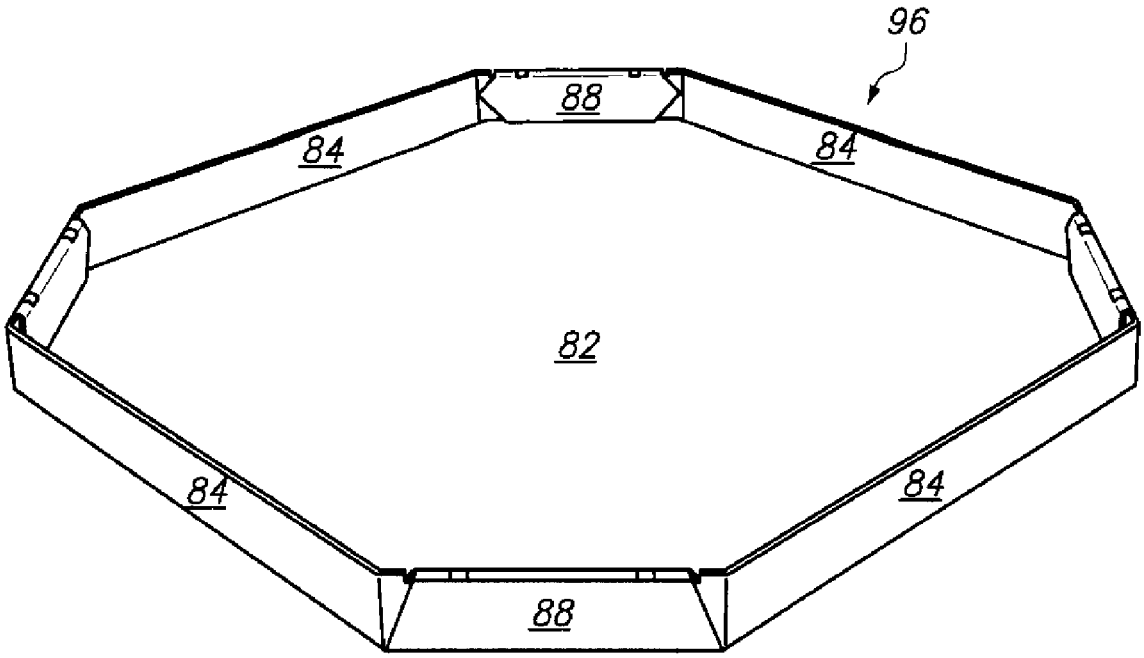
FIG. 10 is a perspective view of an assembled tray formed from the blank of FIG. 9.
Figure 11:
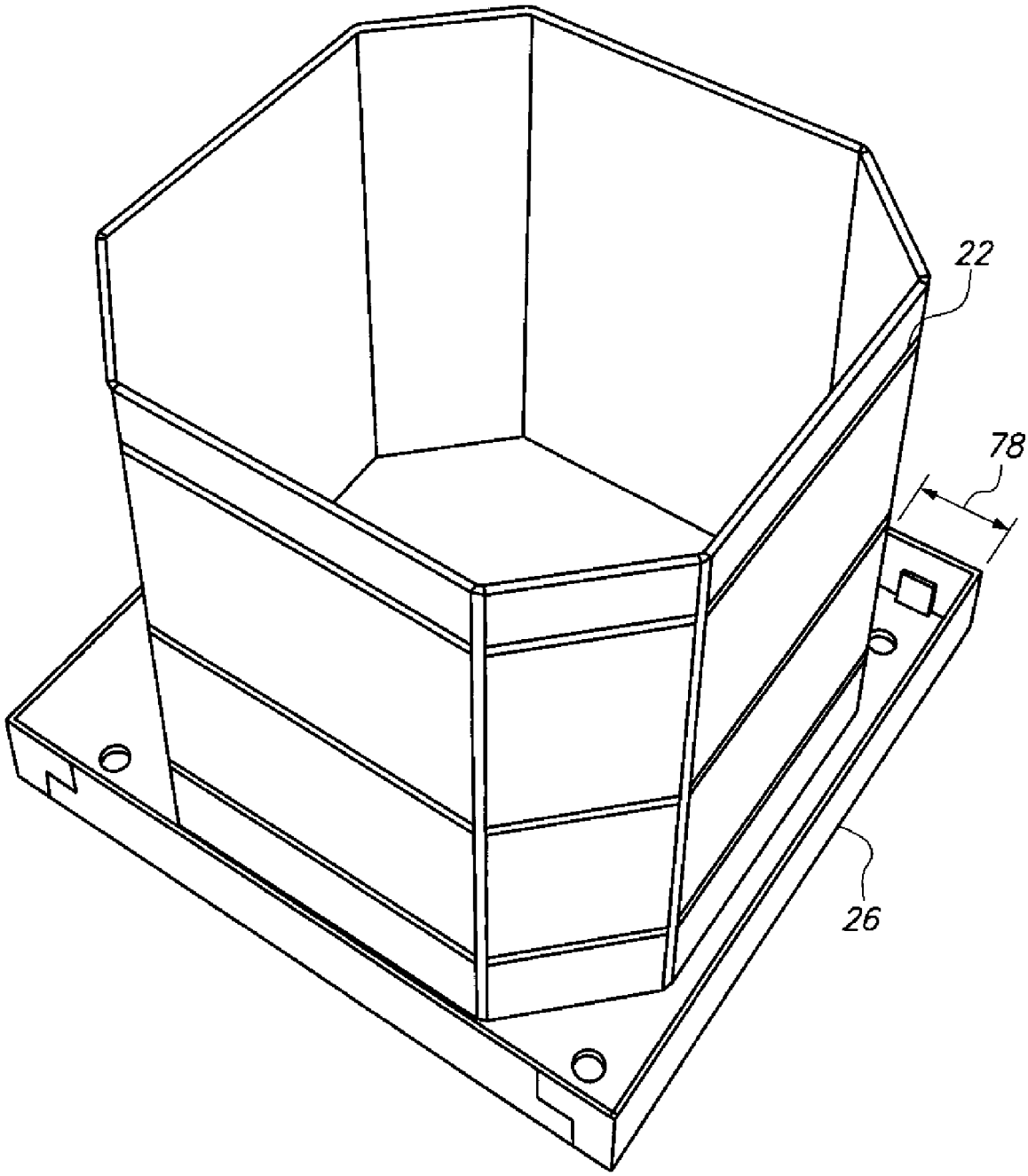
FIG. 11 is a perspective view of the sidewall assembly and top cover made in accordance with an aspect of the present invention; and, FIGS. 12*a*-12*e* are sequential perspective view of the aerial delivery system made operating in accordance with an aspect of the present invention.

FIGS. 9 and 10 depict another aspect of the base plate 58. In this configuration, the base plate 58 is in the form of a tray 76. The tray blank 80 includes a tray bottom panel 82. The trap bottom panel 82 includes tray side panels 84 hingedly attached to the tray bottom panel 82 along fold lines 81. Further, the tray side panels 84 includes tray side panel flaps 86 disposed on opposed ends of the tray side panel 84 along hinge lines 83. An outer tray corner panel 88 is hingedly attached to the tray bottom panel 82 along a fold line 85. The position of the outer tray corner panel 88 is interposed between respective tray side panels 84. Fold line 85 further includes a tray panel slot formed within the fold line 85. An inner tray corner panel 90 is attached with the outer tray corner panel along a fold line 87. Extending from an outer periphery of the inner tray corner panel 90 is a tray tab 92. The tray tab 92 and the tray slot 94 are configured to engage on another once the tray blank 80 is erected into a tray 76.

FIG. 10 depicts the tray 76 formed by the erection of tray blank 80. Specifically, the tray side walls 84 are folded upwardly along fold lines 81. Also tray side 20 panel flap 86 may be folded inwardly slightly along fold line 83. The outer tray corner panel 88 may then be upwardly along fold line 85 and subsequently the inner tray corner panel 90 may be folded downwardly along fold line 87 to bring the outer tray corner panel 88 juxtaposed the inner tray corner panel 90. The tray tab 92 may then be inserted into the tray slot 94 to substantially lock the tray 76 in place. In this configuration, the tray does not include a cover, rather only bottom and side support/protection for the contents 27.

Further, it will be appreciated that additional embodiments may be used as the moveable base plate 58. The general function of the base plate 58 is to provide a bottom surface for the sidewall arrangement 22, thereby providing bottom support the contents 27 placed therein. Additionally, the base plate 58 should be moveable within the sidewall arrangement 22. In this manner the base plate 58 does not impede content deployment once the opening of the aerial delivery system 20 is initiated.

Figures 12A, 12B, 12C, 12D, 12E:
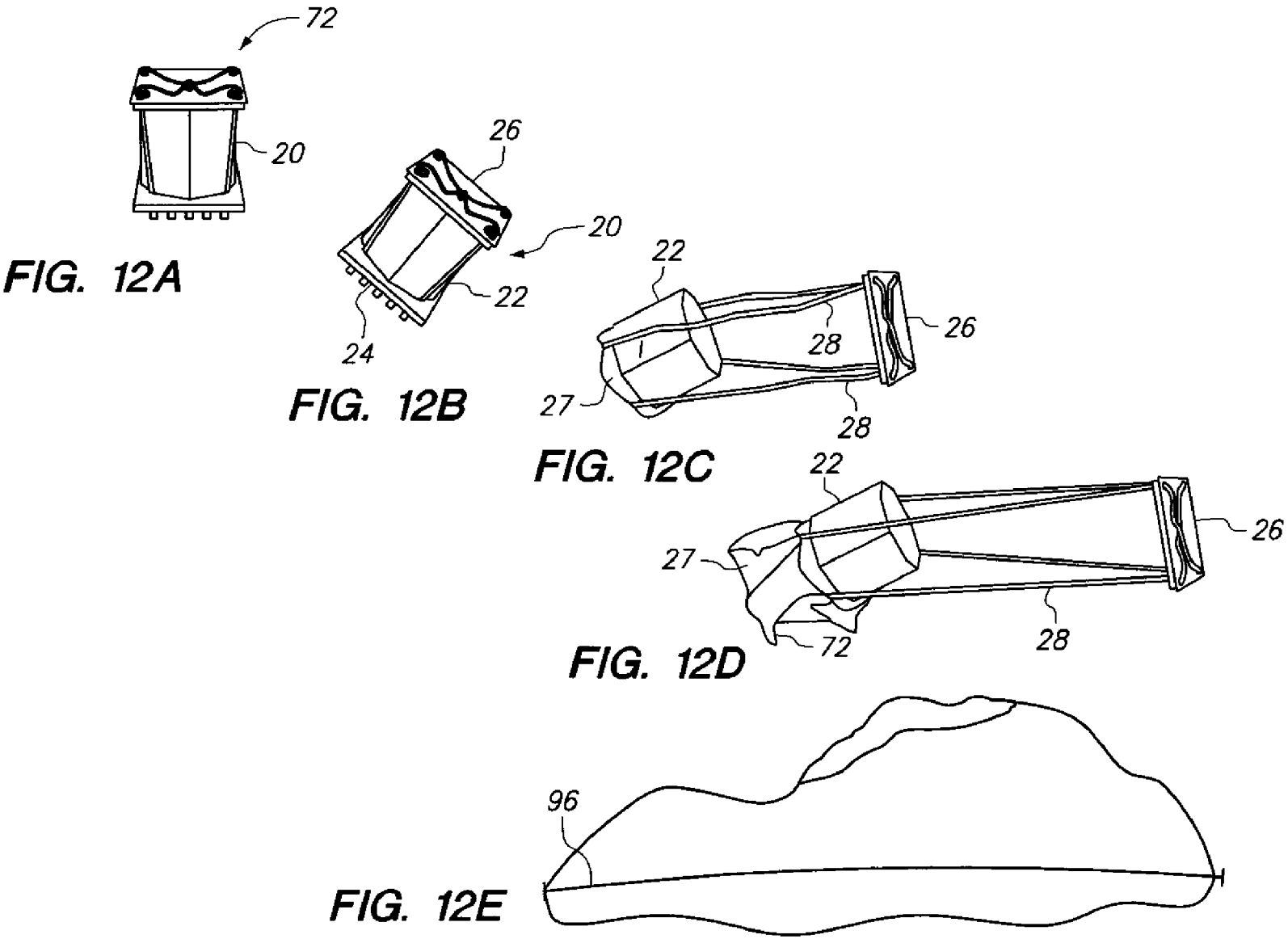

FIGS. 12*a*-12*e* depicts one possible use for the aerial delivery system 20 of the present invention. Specifically, the container is shown being deployed from an aircraft. As seen in FIG. 12*a*, the aerial delivery system 20 may be transported in an aircraft to a deployment area. Once the deployment area is reached, the aerial delivery system 20 may be dropped from the aircraft as depicted in FIG. 12*b*. After being dropped, the aerial delivery system 20 enters the aircraft's slip stream. At this time, the overhang 78 acts as a parachute to pull to top cover from the other aerial delivery system 20 components, as depicted in FIG. 12*c*. As depicted in FIG. 12*d*, the straps 28 become taunt and initiate dispensing of the contents 27. As the aerial delivery system dispenses the contents 27, the contents 27 will cover a desired dispersion area 96, as depicted in FIG. 12*e*.

It will be appreciated that the length of the straps 28 and the amount of overhang may be configured to let the aerial delivery system 20 drop a desired distance from the aircraft before dispensing the contents 27. In this manner, an aircraft may be flown at a higher elevation while still dispensing the contents 27 in an optimal manner at a lower elevation. Likewise, this flexibility allows the aerial delivery system 20 to be deployed from a variety of aircraft having variable flight characteristics.

It will be appreciated that this aerial box delivery system 20 may be used in a variety of manners to deploy any variety of contents 27. In one manner it may be used to deploy water or fire retardant chemicals on fires stored in bags 74 within the sidewall assembly 22. Additionally, the contents of the aerial box delivery system 20 may be natural or man-made materials of a non-liquid nature. One suitable, non limiting example is coconut husks. It has been found that coconut husks have a unique characteristic in that they absorb petroleum products without absorbing water. As such, the aerial delivery system 20 may be used with coconut husks as contents 27 to rapidly and accurately respond to maritime oils spills to limit environmental damage. Additionally, it will be appreciated that the aerial delivery system 20 may be used to accurately deploy any variety of contents 27 to nearly any location, be it sea or land.

While various embodiments of the invention has been illustrated and described, as noted above, many changes can be made without departing from the spirit and scope of the invention. Accordingly, the scope of the invention should be determined entirely by reference to the claims that follow.

What is claimed is:

1. A system for delivering fire retardant to a ground location from an aircraft, the system comprising:

a base defining a support surface;

a rupturable sidewall removeably supported on the base and defining an inner cavity for storing the retardant while the system is being transported in the aircraft;

a top cover adjacent the sidewall for covering the retardant supported on the base and contained within the sidewall, the top cover overhanging the sidewall to provide resistance to the top cover so that the overhang of the top cover catches wind movement and removes the top cover from the sidewall when the system is dropped from the aircraft; and a strap connecting the top cover to the sidewall wherein the strap is sufficiently long so that the strap becomes taut and ruptures the sidewall after the system has traversed a significant distance below the aircraft after being dropped from the aircraft.

2. The system of claim 1 wherein the strap extends from the top cover along an exterior of the sidewall, underneath the sidewall and is attached to an interior surface of the sidewall for ripping the sidewall.

3. The system of claim 1 wherein the top cover has a square configuration and the sidewall has a multi panel configuration for providing the overhang symmetrically about the sidewall.

4. The system of claim 1 wherein the sidewall is a cellulose based material.

5. A system for delivering fire retardant to a ground location from an aircraft, the system comprising:

a base defining a support surface;

a sidewall removeably supported on the base and defining an interior cavity;

a rupturable container for storing the retardant while the system is being transported in the aircraft, the container disposed within the sidewall and supported on the base;

a top cover adjacent the sidewall, the top cover overhanging the sidewall to provide resistance to the top cover so that the overhang of the top cover catches wind movement and removes the top cover from the sidewall when the system is dropped from the aircraft; and a strap connecting the top cover to the rupturable container wherein the strap is sufficiently long so that the strap becomes taut and ruptures the sidewall after the system has traversed a significant distance below from the aircraft after being dropped from the aircraft.

6. The system of claim 5 wherein the strap extends from the top cover along an exterior of the sidewall, underneath the sidewall and is attached to the rupturable container for ripping the rupturable container when the strap becomes taut.

7. The system of claim 5 wherein the rupturable container is a flexible membrane or plastic bag.

* * * * *